United States Patent [19]

Cook et al.

[11] Patent Number: 4,765,174

[45] Date of Patent: Aug. 23, 1988

[54] TEXTURE ENHANCEMENT OF METALLIC TUBING MATERIAL HAVING A HEXAGONAL CLOSE-PACKED CRYSTAL STRUCTURE

[75] Inventors: Charles S. Cook, Murrysville Boro; George P. Sabol, Murrysville, both of Pa.

[73] Assignee: Westinghouse Electric Corp., Pittsburgh, Pa.

[21] Appl. No.: 17,298

[22] Filed: Feb. 20, 1987

[51] Int. Cl.[4] ..... B21C 37/30

[52] U.S. Cl. ..... 72/367; 72/700; 420/422

[58] Field of Search ..... 420/422, 423; 148/11.5 F; 72/700, 367

[56] References Cited

U.S. PATENT DOCUMENTS

| | | | |
|---|---|---|---|
| 3,416,346 | 12/1968 | Arrington | 72/189 |
| 403,487,675 | 1/1970 | Edstrom et al. | 72/370 |
| 3,690,850 | 9/1972 | Edstrom et al. | 29/183 |
| 3,804,708 | 4/1974 | Nilson | 420/422 |
| 4,233,834 | 11/1980 | Matinlassi | 72/208 |

OTHER PUBLICATIONS

Report: WAPD-TM-472, by J. J. Kearns, entitled "Thermal Expansion and Preferred Orientation in Zircoloy", Nov., 1965.

Van Swan, L. F. P. et al.; "Relationship Between Contractible Strain Ratio R and Texture in Zirconium Alloy Tubing", Metallurgical Transactions A, vol. 10A, pp. 483–487, Apr. 1979.

*Primary Examiner*—Lowell A. Larson

[57] ABSTRACT

A method of producing tubing composed of material, such as zirconium and alloys thereof, having a hexagonal close-packed crystal structure is provided which increases the radial texture or orientation of basal poles in the crystal structure of the material. The method includes intermediate and final stages. In the intermediate stage, multiple tubing reductions are performed, which each causes tubing wall thickness and diameter reduction and axial elongation, and a recrystallization anneal is performed following each of the tubing reductions. In the final stage, a last tubing reduction is performed, which causes tubing wall thickness and diameter reduction and axial elongation, and a final anneal is performed following the last tubing reduction. Also, in the intermediate stage, an expansion of the tubing diameter is performed following any one of the multiple tubing reductions and associated recrystallization anneals and then a recrystallization anneal is performed following the diameter expansion and before a next following tubing reduction in either of the intermediate and final stages of producing the tubing. The diameter expansion is an increase of from about five to twelve percent of the diameter of the tubing prior to the diameter expansion. The recrystallization anneal following the diameter expansion is at about 1250 degrees F. The tubing diameter expansion and recrystallization anneal result in enhanced texture of the finished tubing after completion of the final stage.

14 Claims, 2 Drawing Sheets

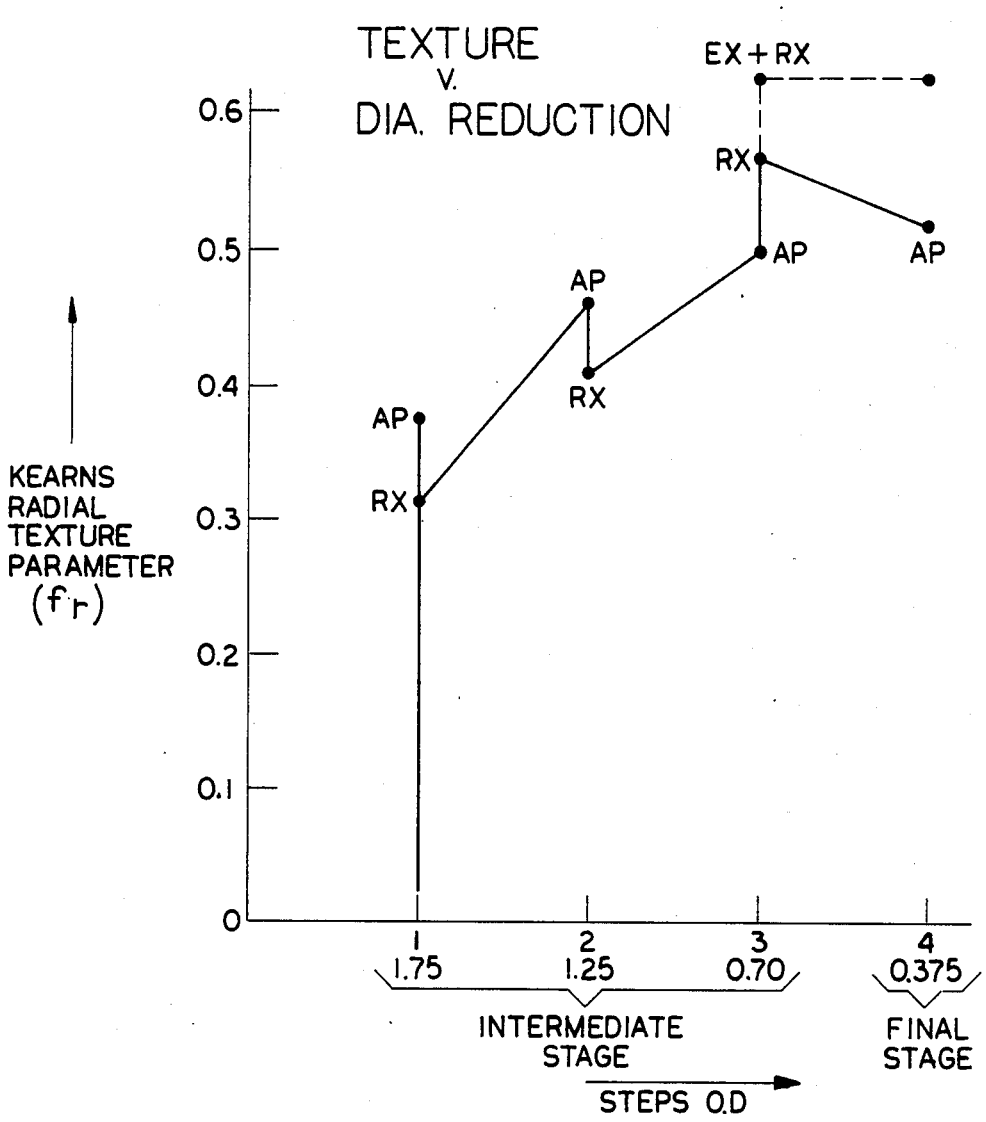
KEY
AP = AS PILGERED
RX = RECRYSTALLIZATION ANNEAL
EX = EXPANSION

TEXTURE ENHANCEMENT OF METALLIC TUBING MATERIAL HAVING A HEXAGONAL CLOSE-PACKED CRYSTAL STRUCTURE

BACKGROUND OF THE INVENTION

1. Field of the Invention

The present invention relates generally to the production of tubing by a combination of mechanical and thermal treatments and, more particularly, is concerned with enhancement of the radial texture of tubes composed of metallic materials, such as zirconium and alloys thereof, which have a hexagonal close-packed crystal structure, by insertion of a diametral expansion and a recrystallization anneal within an otherwise conventional sequence of intermediate diametral and wall thickness reductions and recrystallization anneals leading up to a final diametral and wall thickness reduction and final anneal for the production of such tubes.

2. Description of the Prior Art

The processing procedures applied to production of tubing composed of metallic materials, such as zirconium and alloys thereof, having a hexagonal close-packed crystal structure, conventionally consist of combinations of mechanical and thermal treatments. For instance, the mechanical treatments applied in the production of Zircaloy tubing are the cold deformations produced in tubing by multiple pilger reductions used to reduce the cross-sectional dimensions of the tubing. (A pilgering process produces axial elongation of a tube to a finished size over a stationary mandrel through effecting a reduction in both the diameter and wall thickness of the tube by means of two circumferentially grooved dies that embrace the tube from above and below and roll in a constant cycle back and forth along the tube.) The thermal treatments applied in the production of Zircaloy tubing are the vacuum annealing temperatures used for intermediate (between pilger reductions) and final (after the last pilger reduction) heat treatments. Below about 1000 degrees F., Zircaloy does not recrystallize (depending on the amount of cold work and time at temperature) and thus the heat treatment is termed a stress relief anneal. Above this temperature, it recrystallizes and the heat treatment is then a recrystallization anneal.

One conventional process sequence for production of Zircaloy tubing to be used as nuclear fuel cladding has four basic steps. The first three steps are called intermediate steps and the fourth step is termed the final step. Each step of the intermediate steps includes a pilger reduction pass followed by a recrystallization anneal at about 1250 degrees F. The final step includes a pilger reduction pass followed by a stress relief anneal at about 870 degrees F.

As mentioned above, the multiple pilger reduction passes are employed to elongate the tube by reducing its cross-sectional dimensions. Each reduction is characterized by the total deformation expressed as percent reduction in cross-sectional area and the distribution of this deformation between the radial and circumferential directions (deformation ratio). The deformation ratio (Q ratio) is commonly expressed as a ratio of percent wall reduction to outside diameter reduction. Typically, Q ratios greater than 1, especially in the last or final pilger reduction, are used to produce a textured Zircaloy product resistant to radial hydride formation in service.

Texture is an important property of Zircaloy tubes used as nuclear fuel cladding. It has a strong influence on other properties (mechanical and chemical) which are important to in-service performance of nuclear fuel. Texture in zirconium alloys is commonly determined by x-ray methods and measuring the Kearns parameter, "$f_r$". (For a more detailed discussion of the Kearns texture parameter, $f_r$, attention is directed to a November 1965 report designated WAPD-TM-472 by J. J. Kearns entitled "Thermal Expansion and preferred Orientation in Zircaloy".) The Kearns texture parameter indicates the fraction of all basal poles present in a material that are effectively oriented in any of the three reference directions, radial ($f_r$), circumferential ($f_{rc}$) or axial directions ($f_{ra}$), in a tube. The value of "$f_r$" can vary between 0.0 and 1.0. In an isotropic, untextured material the value of the parameter would be 0.33. For Zircaloy nuclear fuel clad tubing, the Kearns radial texture parameter is usually greater than 0.5 with the basal poles oriented predominantly in the radial direction.

An alternative method of characterizing texture in Zircaloy tubing is to measure the anisotropy of plastic deformation using the contractile strain ratio (CSR) test. CSR is the ratio of circumferential (diameter) to radial (through wall) strains accompanying a small amount of axial elongation in a tensile test. Zircaloy tubes are usually textured with the basal poles generally oriented towards the radial direction. Furthermore, since the resistance to deformation is highest in the basal pole direction, the values of CSR measured in Zircaloy fuel clad tubing are greater than 1.0. CSR and the Kearns texture parameter, $f_r$, both are indications of the degree of texture and they have been shown to be directly related to each other. (Reference: Van Swam, L. F. P. et al; "Relationship Between Contractible Strain Ratio R and Texture in Zirconium Alloy Tubing"; Metallurgical Transactions A, Volume 10A, pages 483–487. April 1979.)

A major factor in determining texture in Zircaloy is the direction of plastic deformation in the three principle directions (axial, circumferential and radial) produced during metalworking. The basal poles align in a plane normal to the direction of tensile or positive plastic deformation and parallel to the direction of greatest compressive or negative deformation. In pilgering, positive deformation takes place in the axial direction resulting, therefore, in the basal poles being oriented in the transverse plane defined by radial-circumferential directions, as seen in FIG. 1. Within the transverse plane, the basal poles tend to be further aligned in the direction of the greatest compressive deformation. In Zircaloy tube manufacturing, the relative amounts of compressive deformation in the radial and circumferential directions control the texture in the final product with a higher proportion of radial compressive deformation producing a more textured product.

The control of texture is a major concern in the development of processing procedures for Zircaloy nuclear fuel clad tubing. By conventional cold reduction in the pilgering process, the ratio of wall reduction to diameter reduction, the Q ratio, is the major controlling parameter in the texture and texture-related contractile strain ratio (CSR) property for the stress relieved zirconium tubing product. The Q ratio, or deformation ratio, is an indication of the relative distribution of deformation in the radial (through wall) to circumferential (diametral) directions produced during pilgering. Thus, the deformation pattern produced during metalworking of tubing is usually characterized by the Q ratio, the ratio of the radial (due to wall reduction) to circumferential (due to diameter reduction) deformations produced during pilgering. Generally, the higher the Q ratio produced in the pilgering operation the greater the radial orientation of the basal poles in the product.

Heretofore, the prevailing thinking within the industry was that the Q ratio of the final pilger reduction is the primary parameter controlling the texture and thus CSR in the zirconium tube product. However, while small changes in texture and CSR may occur with variations in final pilger Q ratio, significant changes have not been obtained and there is clearly other factors that must be considered.

Recent work leading to the present invention, but not forming part of the prior art, has shown that the Q ratio of the multiple pilger reductions during the intermediate steps rather than just that of the final pilger reduction is more important to texture control in stress relieved final products. This work demonstrates that the texture of the final Zircaloy product is much more sensitive to the total processing history than simply the final deformation processing. Texture of Zircaloy tubing is thus established by the combined or "effective" Q ratio of multiple pilger reductions rather than just that of the final pilger pass such that the texture of the material at the intermediate steps of processing has a direct effect on that of the final product.

While this work provides a basis for achieving higher texture and CSR in the final product, there is a limit to how much increase can be achieved in these properties by altering the pilger reduction schedule alone. All conventional metalworking processes for tubing (i.e., pilgering) necessarily consist of reductions in both wall and diameter and a corresponding axial elongation. There is, therefore, a maximum Q ratio that can be applied to the tube and still accomplish the overall objective of converting a large cross section tube extrusion to a small diameter, thin wall fuel clad tube.

Consequently, a need still exists to develop an alternative approach to increasing the texture of zirconium tubing products. Such approach would be one which avoids the necessity of major expenditures in tool design and manufacture to achieve higher Q ratios and product textures. This approach should also be capable of obtaining levels of texture significantly greater than that available by conventional metal working.

SUMMARY OF THE INVENTION

The present invention provides a texture-enhanced tube production method designed to satisfy the aforementioned needs. The present invention provides a method for achieving higher textures than are possible by modifying conventional pilger reduction schedules alone. The method for enhancing the texture of tubing, such as zirconium nuclear fuel clad tubing, is based on interjecting an increment of tensile deformation in the circumferential direction by expansion processing in order to reorient the basal poles normally present in the circumferential-radial plane of the tube to a more radial orientation in the hexagonal close-packed crystal structure of the metallic tubing.

Furthermore, the texture enhancement resulting from expansion processing of tubing at the intermediate steps in tube production also results in a significant texture enhancement in the material after pilgering to final size provided the expanded material is recrystallized after expansion and before final pilgering. Such recrystallization tends to "lock" or "set" the texture resulting, therefore, in a corresponding higher texture in the material after next (which can also be the final) pilger reduction pass. Since texture enhancement of the final product can be obtained by expansion and recrystallization anneal processing of the material at the intermediate stage (or steps), the process is a practical method for routine texture control and enhancement in zirconium nuclear fuel clad tubing.

Accordingly, the present invention is set forth in a method of producing tubing composed of a metallic material having a hexagonal close-packed crystal structure and functions to increase the radial texture of basal poles in the crystal structure. The tubing producing method is comprised of intermediate and final stages, wherein the intermediate stage includes the steps of performing at least one tubing cross-sectional area reduction and a recrystallization anneal following the reduction and the final stage includes the steps of performing a last tubing cross-sectional area reduction and an anneal following the last reduction. The procedure for radial texture enhancement comprises the steps of: (a) performing at least one tubing diameter size expansion during the intermediate stage of producing the tubing; and (b) performing a recrystallization anneal following the size expansion and before the final stage of producing the tubing. More particularly, the size expansion is an increase of from approximately five to twelve percent over the diameter size of the tubing prior to the diameter expansion. While recrystallization anneal following the size expansion is at approximately 1250 degrees F., the temperature is dependent on the degree of coldwork, time at temperature, and the alloy. In the tubing expansion the diameter of the tubing is expanded while the wall thickness thereof is reduced.

Still further, the present invention is directed to a method of producing tubing composed of a metallic material having a hexagonal close-packed crystal structure so as to increase the radial texture of basal poles in the crystal structure, wherein the combination comprises the steps of: (a) in an intermediate stage, performing at least one tubing reduction and preferably multiple tubing reductions, which each tubing reduction causes tubing wall thickness and diameter reduction and axial elongation, and performing a recrystallization anneal following performance of each of the tubing reductions; (b) in a final stage, performing a last tubing reduction, which causes tubing wall thickness and diameter reduction and axial elongation, and performing an anneal following performance of the last tubing reduction; and (c) in the intermediate stage after any one of the tubing reductions, performing at least one expansion of the tubing diameter and performing a recrystallization anneal following performance of the diameter expansion and before the final stage of producing the tubing.

These and other advantages and attainments of the present invention will become apparent to those skilled in the art upon a reading of the following detailed description when taken in conjunction with the drawings.

BRIEF DESCRIPTION OF THE DRAWINGS

In the course of the preceding discussion and following detailed description, reference has been and will be made to the attached drawings in which:

FIG. 2 is a graph used to explain how the texture changes at each step in the process sequence for production of Zircaloy tubing without and with the interjection of the diameter expansion and recrystallization anneal steps of the present invention in the intermediate stage of the tubing production method.

DETAILED DESCRIPTION OF THE INVENTION

Figure 1:
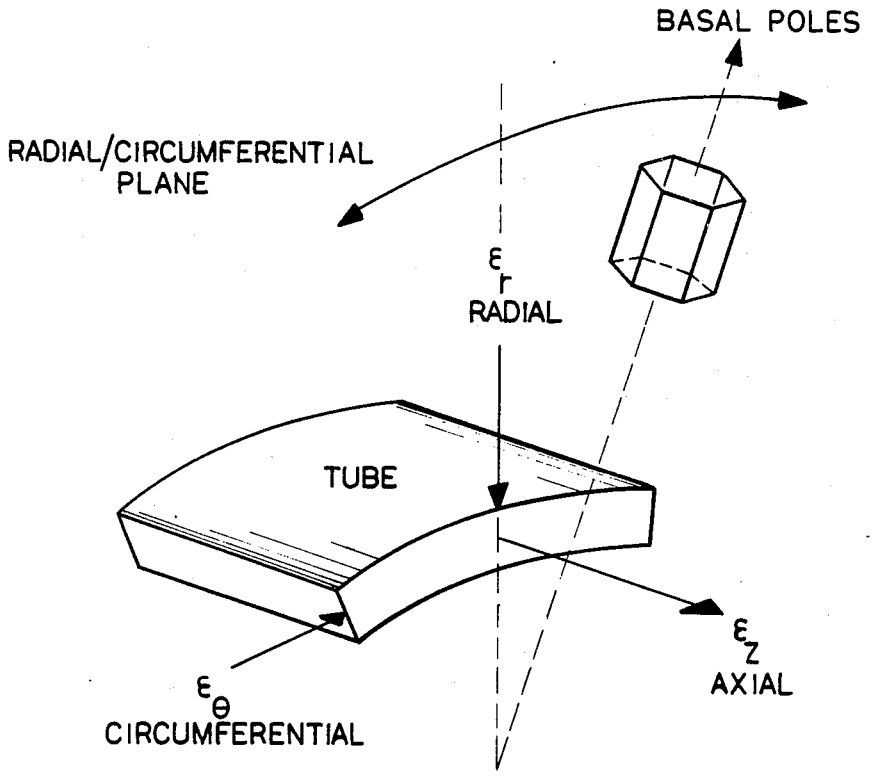
FIG. 1 is a schematic illustration of the basal pole orientation normally produced in Zircaloy tubing by deformation processing such as pilger reduction.

The present invention provides a tube production method wherein the texture of a metallic tubing material, having a hexagonal close-packed crystal structure, is increased by incorporating an increment of circumferential plastic deformation in the form of expansion processing and recrystallization anneal in the tubing production method. Referring to FIG. 1, there is schematically illustrated the relationship of the basal poles of the crystal structure of the metallic tubing to the three directions (radial, circumferential and axial) of deformation of a segment of the tubing. Since the basal poles of the crystal structure tend to be oriented in the plane normal to tensile deformation, an increment of tensile deformation in the circumferential direction is employed to effect a more radial orientation of the basal poles in the transverse plane of the tube. Thus, those circumferentially oriented basal poles contained in the usual spread of basal poles in the tube transverse plane will be oriented to a more radial orientation. An increase in radial orientation of basal poles is an increase in the texture of the tubing material. Since texture provided by the steps at the intermediate stage of processing effect that of the final product, the texture enhancement achieved by this method during the intermediate stage also results in a corresponding texture enhancement of the final product.

The tube producing method of the present invention which increases the radial texture of basal poles in the crystal structure of the material includes intermediate and final stages. In the intermediate stage, multiple tubing reductions are performed in a conventional manner, such as in a pilger mill, which each causes tubing wall thickness and outside diameter reduction and axial elongation. Also, a recrystallization anneal is performed following each of the tubing reductions. Then, in the final stage, a last tubing reduction is performed in the pilger mill, which again causes tubing wall thickness and outside diameter reduction and axial elongation. However, now a stress relief (instead of a recrystallization) anneal is performed following the last tubing reduction. In cladding to be used in a pressurized water nuclear reactor (PWR), recrystallization is not desirable at the final stage since this would reduce the strength of the final product. Recrystallization at each step in the intermediate stage lowers the strength and ductility of the metal so it can be "worked" better.

Referring to the graph in FIG. 2, there is schematically depicted the effect on texture of each tubing diameter reduction by pilgering as represented by "AP" which means "as pilgered" and each recrystallization represented by "RX". Steps (1), (2) and (3) occur in the intermediate stage, whereas step (4) is in the final stage of the tubing production method. In both steps (1) and (2) the texture of the tubing "as pilgered" at AP has a higher value than once it has been recrystallized at RX. Even though the RX texture value increases from step (1) to (2), at each step the AP value is higher than the RX value. However, in step (3) the AP value is less than the RX value. But, in step (4) of the final stage the RX texture value from step (3) is not maintained. The final texture at AP in step (4) is thus reduced from the RX texture value of step (3) even though it is slightly greater than the AP value of step (3).

In accordance with the present invention, also in the intermediate stage, at least one expansion of the tubing diameter is performed following any one of the multiple tubing reductions and recrystallization anneals and then a recrystallization anneal is performed following the diameter expansion and before a next following tubing reduction in either of the intermediate and final stages of producing the tubing. The tubing diameter expansion and recrystallization anneal result in enhanced texture of the finished tubing after completion of the final stage. The graph of FIG. 2 also contains dashed lines which depict the effects of diameter expansion and recrystallization "EX+RX" after the reduction and recrystallization RX at step (3) of the intermediate stage and just precedent to the step (4) of the final stage.

Experimentation has found that a texture increase results when the expanded tubing diameter is over at least eight percent of the diameter of the tubing prior to the diameter expansion. Data has not been developed to determine what happens below an increase of eight percent in diameter or beyond an increase of eleven percent in tubing diameter by the diameter expansion step. The recrystallization anneal following the diameter expansion locks in the texture such that it is at least maintained after the final stage. The recrystallization anneal following the diameter expansion can be performed at about 1250 degrees F. for at least about four hours which is the same for the recrystallization anneals in the three steps at the intermediate stage of the tubing production method.

The circumferential tensile strain producing the tubing diameter expansion can be applied by any suitable methods, such as either mechanical or hydrostatic, in order to produce prescribed levels of tubing diameter expansion and thus circumferential plastic deformation. Mechanical methods can include, for example, pulling a lubricated tool through the tubing or roll expanding from the inside diameter of the tubing. Hydrostatic methods might expand the tubing with an internal hydrostatic pressure to a presecribed level of plastic deformation. Either approach could be used to expand Zircaloy tubing to a prescribed level of circumferential plastic strain or diameter growth. Since the volume of the metal remains constant during deformation, diameter expansion must be accompanied by one or the other or both of tubing wall thickness reduction and axial contraction.

The experimental work carried out with respect to Zircaloy tubing to be used as nuclear fuel cladding and which confirmed the significant enhancement of the texture of the tubing material brought about by the present invention will now be described in detail.

EXPERIMENTAL WORK

Experimental Materials

The manufacture of seamless Zircaloy tubing consists initially of the hot extrusion of a hollow tube followed by a number of cycles of wall and diameter reductions by cold pilgering followed by recrystallization anneals. After the final pilger reduction, the tube to be used for nuclear fuel cladding is given a final stress relief anneal heat treatment. This experimental work concentrated on the last intermediate size material just before the final pilger pass to the final 0.375 inch (0.95 cm) outside diameter (O.D.) by 0.023 inch (0.58 mm) wall thickness (W), 17×17 size product.

Initially, random lengths of recrystallized Zircaloy-4 intermediate size tubing measuring 0.7 inch 0.D. (1.78 cm) by 0.070 inch W (1.8 mm) wall were used. The effects of two expansion methods for applying circumferential deformation and post expansion heat treatment on texture were determined using this material. Since the outside diameter of this material after expansion exceeded the size that could be pilgered by the current final pass pilger tool design, subsequent work concentrated on a smaller intermediate size material. Smaller intermediate material could then be pilgered to final size after expansion to evaluate the effects of intermediate size texture on that of the final product after pilgering. The only intermediate material available which met this requirement was Zircaloy-2 measuring 0.65 inch (1.65 cm) outside diameter by 0.075 (1.9 mm) wall. The chemical analysis of the heat from which this material originated is given in Table 1 infra.

Experimental Processing and Evaluation

Two expansion processes were examined initially for the expansion of the 0.7 inch (1.78 cm) outside diameter Zircaloy-4 tubing: hydraulic and roller expansion. The hydraulic expansion consisted of incrementally pressurizing the tube from the interior and monitoring the diameter growth at the midlength of the tube with a contact transducer. When the desired diameter growth had been achieved, the pressure was released. Mydraulic expansion of the 0.7 inch (1.78 cm) outside diameter material was initially conducted to failure to learn the limits of available deformation. A second, controlled expansion of about ten percent diameter growth was then made on the 0.7 inch (1.78 cm) outside diameter material. Generally, the hydraulic expansion required approximately 20,000 psi (137 MPa) for the expansions performed in this experimental work.

Roller expansion consisted of inserting a three or four roll head into the tube, rotating the roll head, and incrementally expanding the diameter described by the roll set with a mandrel contained in the roll head until the desired tube diameter was achieved. Two levels of expansion were performed on the 0.7 inch (1.78 cm) outside diameter tube, one to determine the limits of deformation available and another to a somewhat lower level of expansion. The texture of the material at both levels of expansion in the as-expanded condition was determined.

Hydraulic expansion was selected for the subsequent expansion of the 0.65 inch (1.65 cm) outside diamter Zircaloy 2 material. These expansions were approximately to the eight percent diameter expansion needed to produce the 0.7 inch (1.78 cm) outside diameter size necessary for subsequent pilgering to final size. Four expanded tubes, two in the as-expanded and two in the expanded plus recrystallized conditions, were pilgered to the final 0.375 inch (0.95 cm) outside diameter by 0.023 inch (0.58 cm) wall tube size.

The evaluation of both the Zircaloy-2 and Zircaloy-4 intermediate size materials consisted of measuring the Kearns "$f_r$" radial texture parameter before and after expansion. The materials used for these texture measurements were taken from the midwall location by machining and then chemical etching to a foil of 0.002 inch (51 micro-meter) thick. The tubes are then slit and glued flat for the texture measurement. The texture evaluation of the Zircaloy-2 material after pilgering to final size included the measurement of CSR as well as the Kearns radial texture parameter. In all conditions, the microstructure of the materials was characterized metallographically. (The photomicrographs have not been included herein.)

Results of Zircaloy-4 Expansions

The level of deformation available by hydraulic and roller expansion was indicated by the expansion trials on the 0.7 inch (1.78 cm) outside diameter intermediate size material. Approximately sixteen percent diameter expansion was produced at the burst location of the hydraulic expansion while the 9.4 percent roller expansion produced an axial crack in the tube. Thus, a greater level of diametral expansion was available by hydraulic expansion.

The results of dimensional and strain analyses of samples taken from two hydraulic expansions and two roller expansions of the 0.7 inch (1.78 cm) outside diameter Zircaloy-4 tubes are given in Table II infra. The strain analysis is based on first calculating the true strains in the principal directions at the mid-wall location based on the changes in diameter and wall thickness measured in the tubes and the principal of constancy of volume in a plactically deforming metal. The engineering strains indicated in Table II were then determined from the true strains. Included in Table II are the ratios of the true strains in the radial and axial directions to the circumferential true strain due to expansion: R/C and A/C, respectively. This information indicates a difference in strain behavior between these two expansion processes. In hydraulic expansion, most (71 to 80%) of the strain accompanying diameter expansion occurs in the radial direction producing primarily wall thinning. In roller expansion, most (65 to 73%) of the strain accompanying diameter expansion occurs in the axial direction producing primarily length contraction.

The results of texture measurements of both hydraulic and roll expanded materials are shown in Table III along with the texture of the original material. The material hydraulically expanded to approximately ten percent (No. 1) in the as-expanded condition was significantly more textured than before expansion. A further significant increase in texture was produced in material No. 1 by a post expansion vacuum anneal at 1250 degrees F. for four hours. An identical increase in texture due to hydraulic expansion was produced in a second, controlled hydraulic expansion to approximately eleven percent (No. 4). Roll expansion to 7.2% and 9.4% (Nos. 5 and 6 in Table III) resulted in a more modest increase in texture.

The microstructures of the material before expansion and after expansion and anneal revealed that the hydraulically expanded material had uniformly recrystallized after expansion to a significantly larger grain size than that of the input material, whereas in the roll expanded material, recrystallization occurred only near the inside diameter, indicating that the deformation produced by roll expansion was non-uniform and concentrated towards the inside diameter. This result probably explains why the texture increase was lower in the roll expanded material than in the hydraulically expanded material since texture measurements were made on material from the midwall location away from the inside diameter where most of the deformation had taken place due to the roll expansion.

Results of Zircalor-2 Expansions

The hydraulic expansion process was selected for continued work because of the uniformity of deformation, the greater level of diameter expansion available, and the greater texture increase observed in hydraulically expanded material. Four, eighteen inch (46 cm) long, 0.650 inch (1.65 cm) outside diameter by 0.075 inch (1.9 mm) wall pieces of Zircaloy-2 were hydraulically expanded by about eight percent to approximately 0.700 inch (1.78 cm) outside diameter).

The results of the dimensional analyses of these tubes using the procedure described above for Table III are given in Table IV. A greater ratio of radial to circumferential true strains was produced in this material than in the 0.700 inch (1.78 cm) outside diameter material. Two of the tubes (Nos. 8 and 9) were given a post-expansion vacuum anneal at 1250 degrees F. for approximately four hours. The microstructure of this material before expansion and after expansion and annealing revealed that uniform recrystallization had again occurred in the annealed material. After removal of the non-uniformly expanded end material and samples for texture measurements, approximately 12 inches (30 cm) of each piece remained for pilgering to final size.

Four pieces were pilgered to 0.375 inch (0.95 cm) outside diameter by 0.023 inch (0.58 mm) wall material by inserting them individually between two standard length pieces currently being pilgered in production in order to assure proper feeding and rotation. This operation produces an area reduction in the material of about eighty percent. Because of the large grain size of the expanded and annealed materials numbered 8 and 9, these pieces were closely examined for cracking especially on the ends after pilgering. There was no evidence of cracking found.

After pilgering, samples of each of the four tubes were taken for texture measurements in the as-pilgered condition and for CSR measurements in the stress relieved condition. The results of these measurements along with texture measurements of the corresponding material before pilgering are given in Table V infra. While the texture of all four tubes was significantly higher before pilgering, only the two tubes (Nos. 8 and 9) which had recieved a post-expansion recrystallization anneal before final pilgering were significantly higher in texture and CSR after pilgering. The texture and CSR of the two tubes (Nos. 7 and 10) which were pilgered to final size from the as-expanded condition was approximately the same as that normally observed in these products.

In the process of generating the Kearns texture parameter, the texture coefficient of the basal poles as a function of angle from the radial direction is produced. The texture coefficient is a measure of the relative number of basal poles versus angle from the radial direction with respect to a randomly textured material. Of course the texture coefficients in a randomly textured material would be equal to one at all angles. This produced additional information regarding the distribution of basal poles in these materials as compared to a typical, fuel tube product. The peak basal pole intensity for a typical fuel tube product lies away from the radial direction (at approximately twenty to thirty degrees) while for both materials produced from expanded intermediate material showed peak basal pole intensities very close to the zero degree, radial position. The peak intensity was highest for the two materials which had received a post-expansion recrystallization anneal before pilgering, which corresponds to the higher texture and CSR measured for this material. It is apparent, however, that expansion processing with or without post-expansion heat treatment results in a textural pattern significantly different than that currently produced in Zircaloy fuel tube product regardless of the level of texture indicated by the Kearns texture parameter or CSR.

The microstructures of these materials in the as-pilgered condition indicated the effect of post-expansion heat treatment before final pilgering. In tubes Nos. 7 and 10 which were expanded only before pilgering, the microstructure was typical of fuel tube product while in tubes Nos. 8 and 9, there was evidence of the larger grain size produced by post-expansion recrystallization before final pilgering.

Discussion and Conclusion

As anticipated, the application of a small level of circumferential deformation to an intermediate size Zircaloy tube by expansion effects a significant enhancement of texture. A further increase in texture by a post-expansion recrystallization anneal is apparently possible but may be sensitive to the amount of deformation applied during expansion. In the Zircaloy-4 experimental materials expanded to slightly greater than ten percent diameter growth, a significant change in texture occurred due to post-expansion recrystallization (Tables II and III). In the Zircaloy-2 material, however, which was expanded to about eight percent, a post-expansion recrystallication did not appear to produce a significant further texture increase (Tables IV and V).

Textural changes produced in the intermediate size material by expansion processing have a significant influence on the texture of the material after pilgering. With or without post-expansion recrystallization before pilgering, the expanded material after pilgering demonstrated an almost radial orientation of peak basal pole intensity compared to the off-radial basal pole peaks normally produced in Zircaloy fuel tubing. In those materials which had received a post-expansion recrystallization heat treatment before pilgering, the texture and CSR after pilgering were significantly higher (Table V). Thus recrystallization of the expanded material effectively "locks-in" the higher texture produced by expansion processing resulting in a correspondingly higher texture in the material after subsequent pilgering. The retention of the high texture after pilgering of an expanded and recrystallized intermediate material could be due to crystal rotation around the basal poles reported to occur during recrystallization of Zircaloy. This rotation may take crystallographic directions of deformation previously used during expansion out of an orientation favorable for deformation in the opposite direction during pilgering, thus resulting in retention of the highly textured structure in the pilgered product.

The deformation produced in Zircaloy tubing by the two expanded processes examined in this experimental work were significantly different. Hydraulic expansion produced uniform deformation to higher levels of total expansion before failure than roll expansion. Furthermore, a majority of the deformation accompanying diameter expansion occurred by wall thinning in hydraulic expansion while in roller expansion a majority of the deformation accompanying diameter expansion occurred by length contraction. Finally, the deformation produced by roller expansion tended to be concentrated towards the inside diameter of the material, whereas, in hydraulic expansion the deformation occurred uniformly through the wall. This non-uniform deformation produced by roller expansion was apparently due to the small roller size resulting in highly localized deformation at the point of contact between the rollers and the inside diameter surface. Because of the uniformity of deformation and greater levels of deformation available, the hydraulic expansion process was judged to be more suitable.

This experimentation has demonstrated that expansion processing can be applied to Zircaloy tubing at an intermediate stage when the length of the tubing is much shorter and the cross-sectional size is much larger than in the final tubing resulting in significant texture enhancement in the product after pilgering. When applied to the intermediate material rather than to the final tube product, there would also be less concern about the effect of the expansion process on dimensional and surface quality. Further texture enhancement than that demonstrated in this experimentation may be possible by applying expansion processing at more than one intermediate stage and/or applying it in multiple cycles of expansion and annealing at a given intermediate stage. While hydraulic expansion was found to be more suitable than roller expansion in this experimentation, other methods may also be equally suitable, such as processes based on drawing a tool through the inside of the tube.

Expansion processing is, therefore, a practical and attractive method for texture control and enhancement in Zircaloy tubing. Since it could be applied to any tube reduction schedule, it is probable that levels of texture greater than that possible by tube reducing alone can be obtained by the addition of expansion processing.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the forms hereinbefore described being merely a preferred or exemplary embodiment thereof.

TABLE I

CHEMICAL ANALYSIS OF ZIRCALOY-2 (WESTERN ZIRCONIUM INGOT NUMBER 2-0224A)

| ELEMENT | SPECIFICATION | INGOT CHEMISTRY - WT. PERCENT TOP | MIDDLE | BOTTOM |
|---|---|---|---|---|
| SN | 1.20–1.70 | 1.55 | 1.43 | 1.41 |
| FE | 0.07–0.20 | 0.15 | 0.13 | 0.14 |
| CR | 0.05–0.15 | 0.11 | 0.09 | 0.10 |
| NI | 0.03–0.08 | 0.05 | 0.04 | 0.05 |
| FE + CR + NI | 0.18–0.38 | 0.31 | 0.26 | 0.29 |
| O | 0.11–0.15 | 0.113 | 0.112 | 0.126 |
| ZR | REMAINDER | 98.03 | 98.20 | 98.17 |

TABLE II

RESULTS OF EXPANSION TRIALS ON 0.7 INCH OD ZIRCALOY-4 TUBES (STARTING DIMENSIONS: 0.705 INCH OD BY 0.071 INCH WALL)

| NO. | EXPANSION METHOD | PROCESSING | EXPANDED DIMENSIONS IN. OD | WALL | ENGR. STRAIN (%) OD | WALL | AXIAL | TRUE STRAIN CIRC. | RADIAL | AXIAL | TRUE STRAIN RATIOS R/C | A/C |
|---|---|---|---|---|---|---|---|---|---|---|---|---|
| 1 | HYD. | 1ST TUBE, 6" FROM BURST | 0.779 | 0.065 | 10.5 | −9.1 | −2.5 | 0.120 | −0.095 | −0.024 | 0.80 | 0.20 |
| 2 | HYD. | 1ST TUBE, 2" FROM BURST | 0.799 | 0.064 | 13.3 | −10.5 | −3.7 | 0.149 | −0.111 | −0.038 | 0.75 | 0.25 |
| 3 | HYD. | 1ST TUBE, 1" FROM BURST | 0.804 | 0.064 | 14.0 | −10.5 | −4.4 | 0.155 | −0.111 | −0.045 | 0.71 | 0.29 |
| 4 | HYD. | 2ND TUBE CONTROLLED EXP | 0.783 | 0.065 | 11.1 | −9.1 | −2.9 | 0.125 | −0.095 | −0.030 | 0.76 | 0.24 |
| 5 | ROLL | 7.2% EXPANSION | 0.756 | 0.069 | 7.2 | −2.1 | −5.7 | 0.080 | −0.021 | −0.058 | 0.26 | 0.73 |
| 6 | ROLL | 9.4% EXPANSION | 0.771 | 0.069 | 9.4 | −3.5 | −6.5 | 0.103 | −0.036 | −0.067 | 0.35 | 0.65 |

TABLE III

KEARNS TEXTURE VALUES OF EXPANDED 0.7 INCH OD ZIRCALOY-4 TUBES

| NO. | EXPANSION METHOD | PROCESSING | KEARNS TEXTURE VALUES (fr) AS-EXPANDED | EXPANDED & RX |
|---|---|---|---|---|
| 1 | HYD. | 1ST TUBE, 6" FROM BURST | 0.64 & 0.64 | — |
| 4 | HYD. | 2ND TUBE, CONTROLLED EXP. | 0.64 | — |
| 5 | ROLL | 7.2% EXPANSION | 0.59 | — |
| 6 | ROLL | 9.4% EXPANSION | 0.58 | — |

NOTE: TEXTURE OF INPUT TUBE = 0.54 AND 0.58 (DUPLICATE MEASUREMENTS)

TABLE IV

RESULTS OF EXPANSION TRIALS ON 0.65 INCH OD ZIRCALOY-2 TUBES (STARTING DIMENSIONS: 0.653 IN. OD BY 0.074 IN. WALL)

| NO. | EXPANDED DIMENSIONS OD | WALL | ENGR. STRAIN (%) OD | WALL | AXIAL | TRUE STRAIN CIRC. | RADIAL | AXIAL | TRUE STRAIN RATIOS R/C | A/C |
|---|---|---|---|---|---|---|---|---|---|---|
| 7 | 0.7095 | 0.0665 | 8.7 | −10.1 | 0.2 | 0.105 | −0.107 | 0.002 | 1.02 | 0.02 |
| 8 | 0.7090 | 0.0678 | 8.6 | −8.4 | −1.4 | 0.102 | −0.088 | −0.014 | 0.86 | −0.14 |
| 9 | 0.7030 | 0.0675 | 7.7 | −8.8 | −0.1 | 0.093 | −0.092 | −0.001 | 0.99 | −0.01 |
| 10 | 0.7035 | 0.0690 | 7.7 | −6.8 | −2.1 | 0.092 | −0.070 | −0.022 | 0.76 | −0.24 |

TABLE V

KEARNS TEXTURE AND CSR VALUES OF EXPANSION PROCESSED ZIRCALOY-2 TUBING BEFORE AND AFTER PILGERING TO FINAL 0.375 INCH OD SIZE

| | KEARNS TEXTURE PARAMETERS | | | CSR |
|---|---|---|---|---|
| NO. | AS EXPANDED | EXPANDED & RX | AS-PILGERED | PILGERED AND SRA |
| 7 | 0.65 | — | 0.53 | 1.41 |
| 8 | — | 0.65 | 0.62 | 2.30 |
| 9 | — | 0.66 | 0.61 | 2.23 |
| 10 | 0.59 | — | 0.52 | 1.54 |

NOTE: KEARNS TEXTURE PARAMETER OF INPUT TUBE = 0.53

We claim:

1. In a method of producing tubing composed of a metallic material having a hexagonal close-packed crystal structure so as to increase the radial texture of basal poles in the crystal structure, said producing method including intermediate and final stages, said intermediate stage including the steps of performing at least one tubing cross-sectional area reduction and a recrystallization anneal following said reduction, said final stage including the steps of performing a last tubing cross-sectional area reduction and a final anneal following said last reduction, a radial texture enhancement procedure comprising the steps of:

(a) peforming at least one tubing diameter size expansion during said intermediate stage of producing said tubing; and (b) performing a recrystallization anneal following said size expansion and before said final stage of producing said tubing.

2. The method as recited in claim 1, wherein said size expansion is an increase of from about five to twelve percent of said diameter size of said tubing prior to said size expansion.

3. The method as recited in claim 1, wherein said recrystallization anneal following said diameter expansion is at about 1250 degrees F. for at least about four hours.

4. The method as recited in claim 1, wherein in said tubing expansion the diameter of said tubing is expanded while the wall thickness thereof is reduced.

5. In a method of producing tubing composed of a metallic material having a hexagonal close-packed crystal structure so as to increase the radial orientation of basal poles in the crystal structure, the combination comprising the steps of:

(a) in an intermediate stage, performing at least one tubing reduction, which causes tubing wall thickness and diameter reduction and axial elongation, and performing a recrystallization anneal following performance of said tubing reduction;

(b) in a final stage, performing a last tubing reduction, which causes tubing wall thickness and diameter reduction and axial elongation, and performing an anneal following performance of said last tubing reduction; and (c) in said intermediate stage, performing at least one expansion of the tubing diameter and performing a recrystallization anneal following performance of said diameter expansion and before said final stage of producing said tubing.

6. The method as recited in claim 5, wherein said diameter expansion is an increase of from about five to twelve percent of said diameter of said tubing prior to said diameter expansion.

7. The method as recited in claim 5, wherein said recrystallization anneal following said diameter expansion is at about 1250 degrees F. for at least about four hours.

8. The method as recited in claim 5, wherein in said tubing diameter expansion the diameter of said tubing is expanded while the wall thickness thereof is reduced.

9. The method as recited in claim 5, wherein each recrystallization anneal during said intermediate stage is at about 1250 degrees F.

10. In a method of producing tubing composed of Zircaloy material having a hexagonal close-packed crystal structure so as to increase the radial orientation of basal poles in the crystal structure, the combination comprising the steps of:

(a) in an intermediate stage, performing multiple tubing reductions, which each causes tubing wall thickness and diameter reduction and axial elongation, and performing a recrystallization anneal following performance of each of said tubing reductions;

(b) in a final stage, performing a last tubing reduction, which causes tubing wall thickness and diameter reduction and axial elongation, and performing a anneal following performance of said last tubing reduction; and (c) in said intermediate stage, performing at least one expansion of the tubing diameter following any one of said multiple tubing reductions and associated recrystallization anneal and performing a recrystallization anneal following performance of said diameter expansion and before a next following tubing reduction in either of said intermediate and final stages of producing said tubing.

11. The method as recited in claim 10, wherein said diameter expansion is an increase of from about five to twelve percent of said diameter of said tubing prior to said diameter expansion.

12. The method as recited in claim 10, wherein said recrystallization anneal following said diameter expansion is at about 1250 degrees F.

13. The method as recited in claim 10, wherein in said tubing diameter expansion the diameter of said tubing is expanded while the wall thickness thereof is reduced.

14. The method as recited in claim 10, wherein each recrystallization anneal during said intermediate stage is at about 1250 degrees F.

* * * * *